US005688189A

United States Patent [19]

Bland

[11] Patent Number: 5,688,189

[45] Date of Patent: Nov. 18, 1997

[54] GOLF PUTTER

[76] Inventor: Bertram Alvin Bland, #24 Ambassadors Ct., Fairways, Maraval, Trinidad/Tobago

[21] Appl. No.: 552,414

[22] Filed: Nov. 3, 1995

[51] Int. Cl.[6] ..... A63E 53/04

[52] U.S. Cl. ..... 473/314; 473/330; 473/336; 473/340

[58] Field of Search ..... 473/334, 335, 473/336, 330, 340, 305, 315, 246, 313, 314, 251, 252, 256, 291

[56] References Cited

U.S. PATENT DOCUMENTS

| | | | |
|---|---|---|---|
| 2,155,830 | 4/1939 | Howard | 473/246 |
| 3,220,733 | 11/1965 | Saleeby . | |
| 3,606,327 | 9/1971 | Gorman | 473/337 |
| 3,909,005 | 9/1975 | Piszel . | |
| 3,979,122 | 9/1976 | Belmont . | |
| 4,052,075 | 10/1977 | Daly . | |
| 4,180,269 | 12/1979 | Thompson . | |
| 4,508,345 | 4/1985 | Drake | 473/330 |
| 4,607,846 | 8/1986 | Perkins . | |
| 4,776,594 | 10/1988 | Rango | 473/330 |
| 4,828,266 | 5/1989 | Tunstall . | |
| 4,872,684 | 10/1989 | Dippel . | |
| 4,895,371 | 1/1990 | Bushner . | |
| 4,962,932 | 10/1990 | Anderson . | |
| 5,013,041 | 5/1991 | Sun et al. . | |
| 5,090,698 | 2/1992 | Kleinfelter . | |
| 5,230,509 | 7/1993 | Chavez . | |
| 5,244,210 | 9/1993 | Au . | |
| 5,340,107 | 8/1994 | Baker et al. . | |
| 5,447,310 | 9/1995 | Jernigan | 473/330 |
| 5,571,053 | 11/1996 | Lane | 473/340 |

FOREIGN PATENT DOCUMENTS

| | | | |
|---|---|---|---|
| 713954 | 7/1965 | Canada . | |
| 8 | 1/1995 | Trinidad/Tobago . | |
| 9 | 1/1995 | Trinidad/Tobago . | |
| 2278063 | 11/1994 | United Kingdom | 273/167 H |

*Primary Examiner*—Sebastiano Passaniti
*Attorney, Agent, or Firm*—Lowe, Price, LeBlanc & Becker

[57] ABSTRACT

A golf putter includes a putter head which utilizes a weight management system to allow for an infinite variation in putter sweet spot adjustment. In one embodiment, the putter head combines a flat putting surface with a cylindrical bore which receives the weight management system. Alternatively, a cylindrical putter head is provided which has a diameter matching the diameter of a golf ball. The cylindrical putter head can also have a threaded interior bore for receipt of the weight management system.

2 Claims, 4 Drawing Sheets

Fig. 4
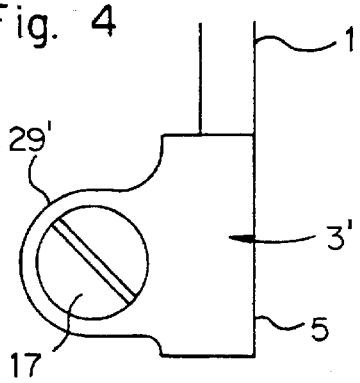
Fig. 5
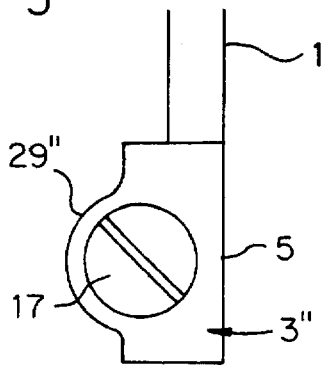
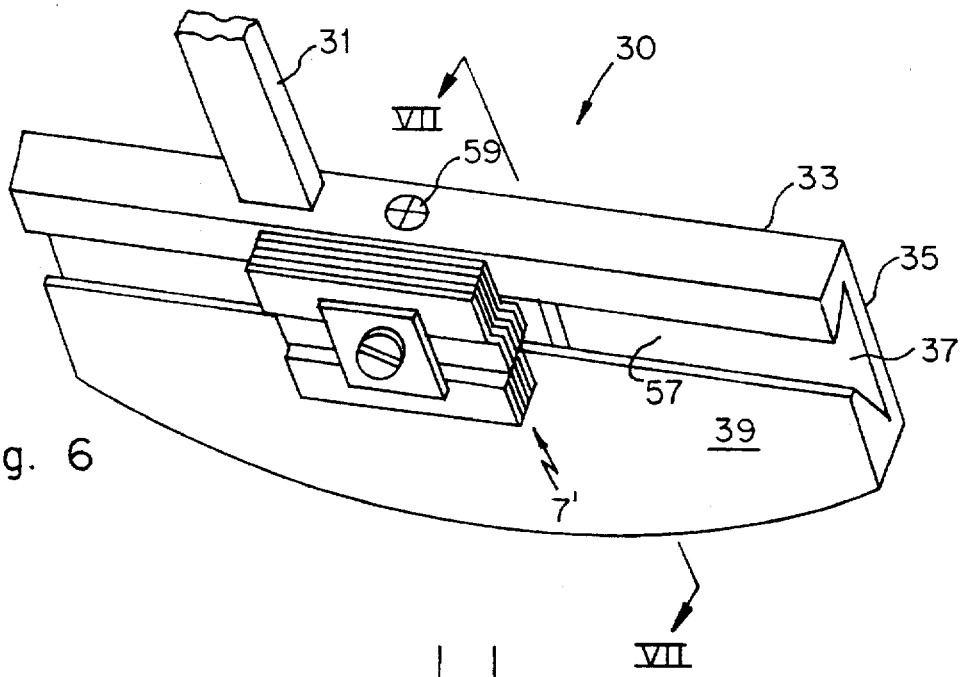
Fig. 6
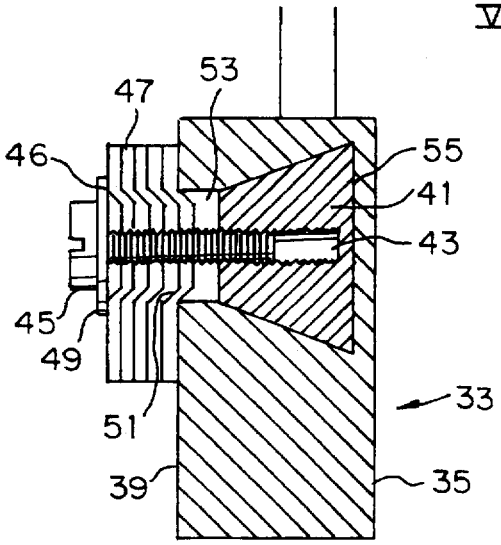
Fig. 7

GOLF PUTTER

FIELD OF THE INVENTION

The present invention is directed to a golf putter and, in particular, to a golf putter using a weight management system for adjusting the putter's sweet spot and overall weight and a golf putter utilizing a cylindrical putter head.

BACKGROUND ART

In the prior art, various systems have been proposed for adding weights to putter heads. Many of these systems utilize pre-drilled ports which are located in the back face of the heel and toe areas of the putter. "Mallet" putters have also been proposed with ports under the sole plates to accommodate weight discs.

In addition, putters have been proposed with cylindrical putter heads.

Some of the drawbacks associated with these prior art putters include extremely complicated systems for weight adjustment. U.S. Pat. No. 5,244,210 to Au discloses a golf putter system having a complicated arrangement of plugs, springs and weights for weight adjustment.

Other prior art putters offer limited weight adjustability. For example, U.S. Pat. No. 3,220,733 to Saleeby discloses a putter with a detachable weight. In order to vary the weight, a group of attachable weights must be employed for each putter. Further, the entire detachable weight require removal and insertion of another weight for weight adjustment.

Another drawback associated with prior art putters is the inability to offer infinite adjustment capability. U.S. Pat. No. 4,828,266 to Tunstall discloses a golf club which has weight-receiving bores in the heel and toe portions. This golf club offers only limited adjustability in the weight of the putter head due to its particular configuration.

Prior art cylindrical putters are disadvantageous in that they tend to impart overspin to a golf ball when used. U.S. Pat. No. 3,909,005 to Piszel discloses a putter club having a diameter of 1¼ inches which is smaller than the standard diameter of a golf ball. The problem with these types of putters is imparting undesirable underspin to the golf ball when stroked. Since the diameter of the cylindrical putter is less than the golf ball diameter, the putter head could strike the ball below its center line, thereby imparting underspin to the ball.

In view of the disadvantages noted above, a need has developed to provide an improved putter.

Responsive to this need, the present invention provides a golf putter which overcomes the problems in known cylindrical putters and putters having limited weight adjustability and sweet spot tuning.

SUMMARY OF THE INVENTION

Accordingly, it is a first object of the present invention to provide an improved cylindrical putter.

Another object of the present invention is to provide a putter having a weight management system which offers infinite adjustability.

A further object of the present invention is to provide a golf putter which permits fine tuning of the putter sweet spot by concentrating a portion of the putter mass at the putter's sweet spot.

A still further object of the present invention is to provide a putter head which is simple in design and easily manufactured.

Yet another object of the present invention is to provide a putter having an improved means for attaching the putter shaft to the putter head.

Other objects and advantages of the present invention will become apparent as a description thereof proceeds.

In satisfaction of the foregoing objects and advantages, the present invention provides a putter comprising a shaft and a putter head attached to the end of the shaft. The putter head has a flat putting surface and a sweet spot adjuster. The sweet spot adjuster further comprises a cylindrical threaded bore extending through a portion of the putter head, the threaded bore being aligned parallel to the flat putting surface. A unitary threaded weight assembly sized to be threaded into the cylindrical threaded bore is also provided. The unitary threaded weight assembly is movable along the axis of the cylindrical threaded bore to fine tune a location of the sweet spot in the putter head. The unitary threaded weight assembly can be one or a pair of threaded plugs, each with at least one a slotted face. When using one plug, the plug is designed to retain one or more weights. When using a pair of threaded plugs, weights or weights and spacers are sandwiched between the threaded plugs to form the unitary threaded weight assembly.

In alternative embodiments, the putter can comprise an elongated plate with a cylinder secured thereto, the cylinder including the cylindrical threaded bore therethrough. Alternatively, the putter can be formed in a one piece or integral design to include the sweet spot adjuster therein. The cylindrical threaded bore in the putter head can be positioned near the flat putting surface or spaced therefrom.

In another embodiment of the invention, a putter comprises a shaft and a putter head attached to the end of the shaft, the putter head having a flat putting surface and a sweet spot adjuster which further comprises a slot in a surface of the putter head opposite the flat putting surface. A unitary weight assembly is provided having a portion sized to engage the slot for slidable movement along the length of the slot. The unitary weight assembly is adjustable in weight to facilitate fine tuning of a location of the sweet spot and also permitting adjustment of the overall weight of the putter. Preferably, the slot is trapezoidal in cross-section and the weight assembly comprises a plug sized to slide within the slot, a fastener attachable to the plug and one or more weights to be secured to the plug by the fastener.

In a third embodiment, a cylindrical putter is disclosed comprising a shaft and a putter head having a cylindrical shape. The putter head includes a pair of opposing bores separated by a center portion which bisects the putter head. The shaft is attached to the putter head at the center portion. The diameter of the cylindrical putter head approximates the diameter of a golf ball, i.e., about 1.5 inches. The center portion is preferably bored to receive an end of the shaft, the shaft's end secured in the bore with an adhesive or the like. The putter head also includes a pair of spaced apart circumferential reference indicia on an outer surface thereof, the reference indicia disposed on either side of the center portion and a longitudinal reference indicia on the top of the putter from heel to toe.

In a fourth embodiment, a cylindrical putter includes a shaft and a cylindrically-shaped putter head. Again, the diameter of the putter head approximates the diameter of a golf ball. The cylindrically-shaped putter head includes opposing heel and toe bores and a weight adjuster. The weight adjuster includes at least one of the bores having an internally threaded portion so as to interface with a weight assembly having a complementary threaded portion for insertion into one or both of threaded heel and toe bores. The weight assembly is movable in either or both bores for adjusting the sweet spot of the putter and its weight distribution. Preferably, the weight assembly is similar to that described in the first embodiment above which utilizes one or more threaded plugs each having a slotted end to facilitate plug rotation. When using one threaded plug, the plug includes a leg to receive one or more of the annular weights, the weights secured by a fastener. When using a pair of plugs, the weights are disposed therebetween for weight and sweet spot adjustment.

In a fifth embodiment, a cylindrical putter comprises a shaft and a cylindrical putter head having a diameter approximating the diameter of a golf ball. The cylindrical putter head has a bore therethrough so that the cylindrical putter head can be made out of ordinary tubing or pipe. A hosel or a saddle is secured to an outer surface of the putter, the end of the hosel being hollow to receive the shaft. In this embodiment, the bore through the cylindrical putter head may be threaded to receive a weight assembly as described above for weight and sweet spot adjustment. The hosel is preferably cast or forged and can be attached to the cylindrical putter head using an adhesive, mechanical fastening means or an equivalent thereof.

BRIEF DESCRIPTION OF THE DRAWINGS

Reference is now made to the drawings of the invention wherein:

FIG. 4 is an alternative putter head design of the first embodiment;

FIG. 5 is another alternative embodiment of the putter head of the first embodiment described above;

FIG. 6 is a second embodiment of the invention in perspective view;

FIG. 7 is a cross-sectional view along the line VII—VII of FIG. 6;

DESCRIPTION OF THE PREFERRED EMBODIMENTS

The present invention relates to an extremely simple manipulation of total putter head weight by including features to permit adjustment of the putter head sweet spot or balance the putter head to suit the requirements of any player. In addition, according to the invention, the inventive cylindrical putter head having a diameter approximating a golf ball diameter facilitates equator to equator contact between the putter head and the ball preventing underspin while promoting desirable overspin or rolling of the ball. This action occurs regardless of the forward, vertical or aft orientation of the shaft as it propels the ball along a predetermined path.

According to the invention, the inventive putter head provides a putter head weight management system which allows fine tuning of the putter head sweet spot along the putter head toe-heel axis in increments that are infinite. The inventive weight management system provides a degree of simplicity and effectiveness not disclosed in prior art putter heads. The fine tuning described above can be achieved by utilizing a simple screwdriver and moving a weight assembly for or aft along the toe-heel axis of the putter head as desired by a golfer.

The inventive cylindrical putter head, by its tubular design, also makes it easier to manufacture than known putter heads.

Figure 1:
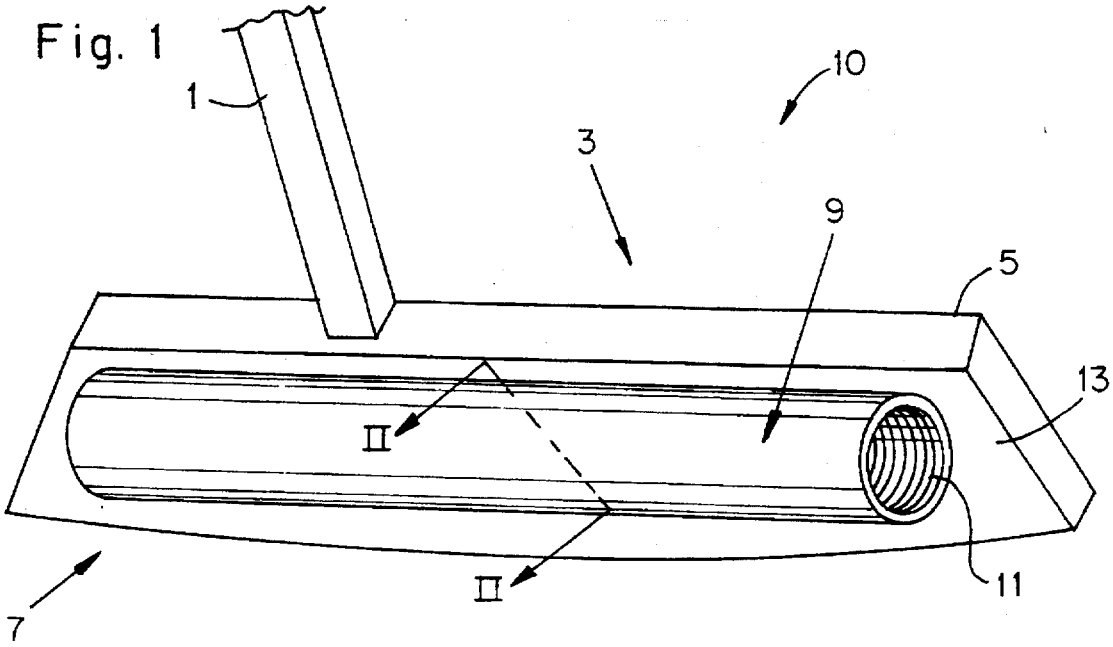
FIG. 1 is a perspective view of a first embodiment of the invention.

Referring now to FIG. 1, a putter according to a first embodiment of the invention is generally designated by the reference numeral 10 and is seen to include a putter shaft 1 and a putter head 3. The putter head 3 includes a flat putting surface 5 and a weight management system designated by the reference numeral 7. As part of the weight management system 7, a cylinder 9 is provided having a threaded bore 11 therethrough. The cylinder 9 can be attached to the face 13 of the putter head in any known manner, for example, by adhesives, welding, bracing, soldering or the like.

Figure 2:
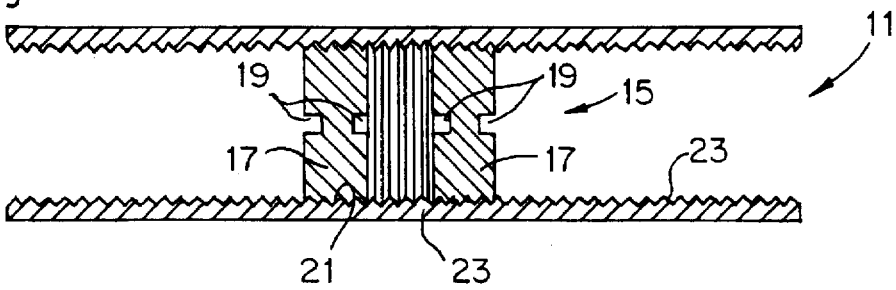
FIG. 2 is a cross-sectional view along the lines II—II of FIG. 1.

With reference now to FIG. 2, the weight management system 7 also includes a weight assembly designated by the reference numeral 15. In this embodiment, the weight assembly 15 includes a pair of plugs 17, each plug having slotted surfaces 19. The plugs 17 have threads 21 which complement the internal threads 23 of the bore 11 so that the plug 17 when rotated can travel along the heel to toe axis of the bore 11.

The weight assembly 15 also includes a plurality of weights 23 preferably in the form of washers. The weights 23 are sandwiched between the plugs 17 to form a unitary weight assembly so no gaps exist between the ends of the assembly. By tightening the plugs 17 against the weights 23, a precise and concentrated weight mass is provided which can be located at any point on the axis of the bore 11. The unitary weight assembly 15 concentrates the mass thereof for maximum sweet spot effect and club power for the putter. The combination of the weights 23 and plug 17 act as a single weight mass for improved putter performance.

The pair of slots 19 in each plug permits screwdriver access from either end of the bore 11 and use of either slot of the plug in case of slot wear.

In use, the weight assembly 15 can be moved along the putter length to alter the putter weight or sweet spot to suit a particular player's desires or the particular golfing conditions prior to or during play. Thus, a user may alter the putter performance during the game to gain a competitive advantage over others.

In a preferred embodiment, the putter weight without the weight assembly is approximately 8 to 9 ounces. The weight assembly 15 can then total up to about 3 ounces to make the overall putter weight about 11 to 12 ounces. The 3 ounce approximation for the weight assembly can be achieved by utilizing different width plugs and/or weights to provide flexibility and weight adjustment.

Figure 3A:
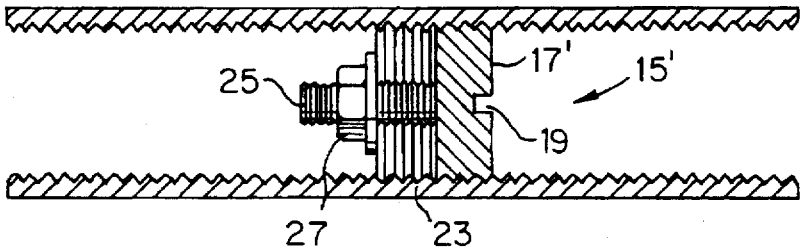
FIGS. 3*a* and 3*b* are a cross-sectional views of alternative embodiments to the weight assembly depicted in FIG. 2.

Referring to FIG. 3*a*, an alternative weight assembly is generally designated by the reference numeral 15'. This weight assembly 15' includes a plug 17' having a slot 19 on one end and a threaded leg 25 on the other end. The weights 23 can then be inserted on the leg 25 and secured with fastening nut 27. With this embodiment, movement of the weight assembly 15 is achieved by rotating the plug 17' via the slot 19 for travel along the axis of the heel to toe bore 11.

Figure 3B:
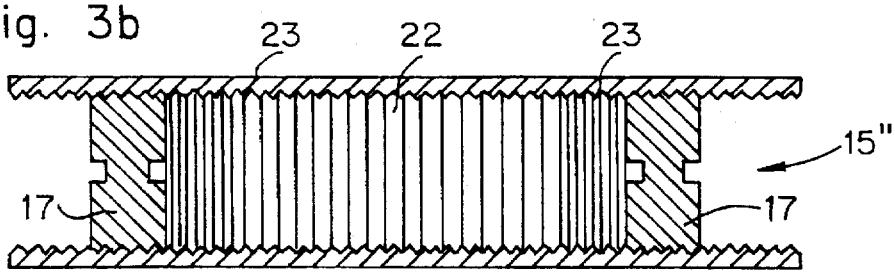

In FIG. 3*b*, a further alternative weight assembly 15", similar to that disclosed in FIG. 2, uses a plurality of light weight spacers or washers 22 which could be made of aluminum, magnesium or plastic. In this embodiment, the sweet spot is spread over a wider portion of the putter.

FIGS. 4 and 5 show alternative embodiments to the embodiment disclosed in FIG. 1. In FIG. 4, the putter head is designated by the reference number 3'. The putter head 3' includes a rear portion 29' which houses the bore 11. In this embodiment, the weight management system 7 is spaced from the putting surface 5 so that the axis of the shaft 1 avoids intersection with the bore 11.

In contrast to the FIG. 4 embodiment, FIG. 5 shows another putter head 3" which includes the rear portion 29" more closely situated to the putting surface 5. In this embodiment, the axis of the shaft 1 intersects the bore 11 of the weight management system 7.

A second embodiment of the invention is shown in FIG. 6 and generally designated by the reference numeral 30. In this embodiment, the inventive putter includes a shaft 31 and a putter head 33 having a flat putting surface 35.

The putter head 33 includes a trapezoidal-shaped slot 37 extending from the putter heel to the putter toe, the slot 37 opening into the rear face 39 of the putter head 33.

A weight management system 7' is also provided to interface with the slot for putter weight and sweet spot adjustment.

Referring now to FIG. 7, the weight management system 7' includes a trapezoidal-shaped plug 41 having a threaded bore 43 therein. A screw 45 having threads complementary to those in the bore 43 is provided with a series of weights 47. Each weight 47 has a through opening 49 to receive the screw 45 for mounting purposes. In addition, the weights 47 include a step portion 51 which is sized to fit within the opening 53 and form a tight fit when the screw 45 is threaded into the plug 41. The tolerance between the slot 37 and plug 41 dimension should be tight so that no gap exists between the face 55 of the plug and the opposing face 57 of the slot, see FIG. 7. Of course, other configurations of the plug and weights could be used.

In use, one or more of the weights 47 is mounted on the screw 45 which is then threadably attached to the plug 41. The plug is then slid in the slot 37 for sweet spot and weight adjustment and the screw 45 is tightened to hold the assembly in place. Once the sweet spot is determined, it can be marked with some form of an indicia such as 59, see FIG. 6, for future reference. A washer 46 can also be used to further secure the weights 47 to the plug 41.

Figure 8:
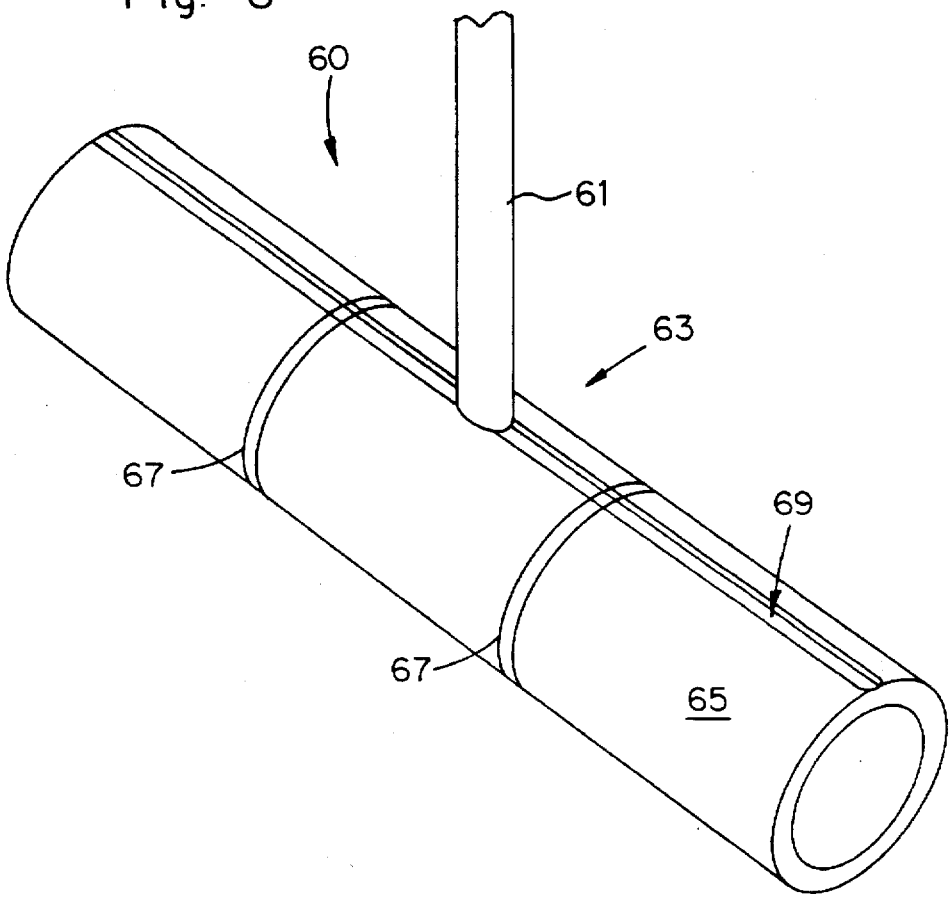
FIG. 8 is a perspective view of a third embodiment of the invention.
Figure 9:
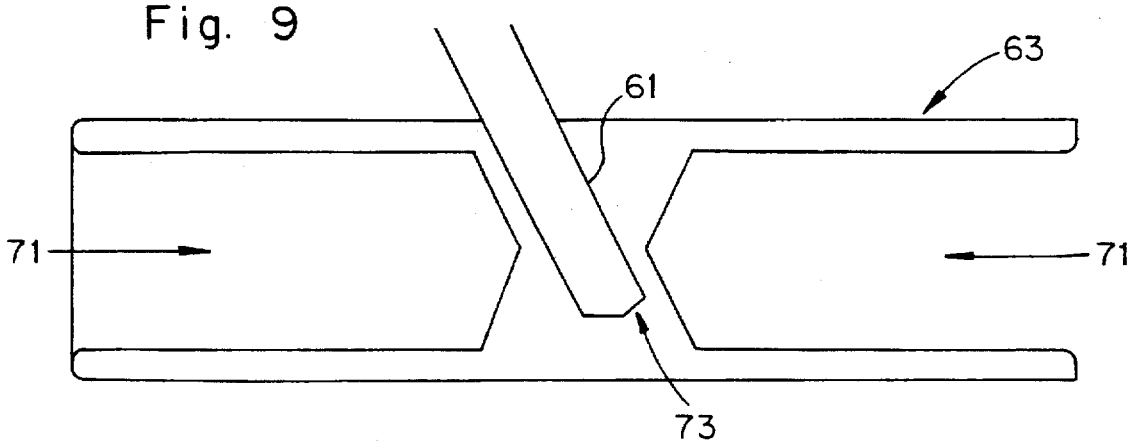
FIG. 9 is a cross-sectional view of the putter head shown in FIG. 8.

FIGS. 8 and 9 show a third embodiment of the invention generally designated by the reference numeral 60. In this embodiment, a shaft 61 and cylindrical putter head 63 form the inventive putter. The outer surface of the cylindrical head 65 can include a pair of grooves 67 to facilitate putting. In addition, a heel to toe access reference groove 69 can also be provided for putting. The grooves 67 and 69 can be painted or colored to assist in their location and use.

Referring to FIG. 9, the putter head 63 is partially hollow with bores 71 extending within the putter head 63. Each of the bores 71 are separated by a center portion which is designed to receive the shaft 61. The diameter of the bore head 63 is about 1.5 inches which approximates the diameter of a golf ball. The putter head 63 is easily manufactured by merely using a solid rod and boring out the ends to form the bores 71.

Figure 10:
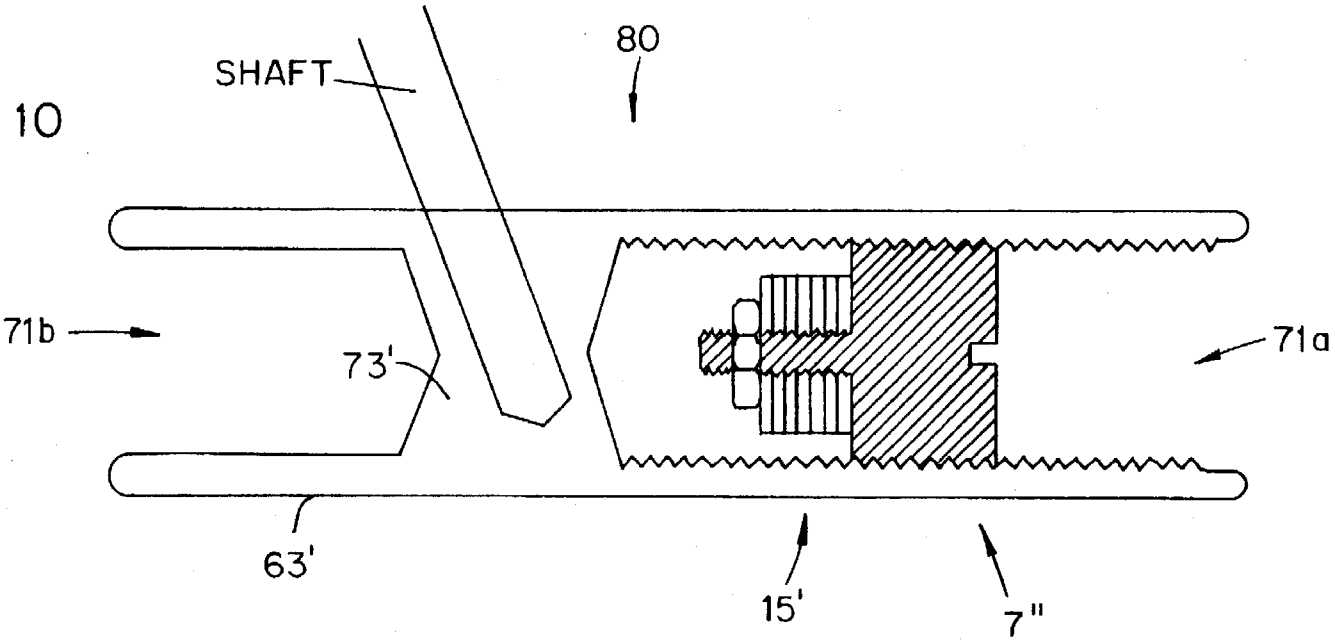
FIG. 10 is a cross-sectional view of a fourth embodiment of the present invention.

FIG. 10 shows a fourth embodiment of the invention which is generally designated by the reference numeral 80. In this embodiment, a cylindrical putter head 63' is used which is similar to that disclosed in FIGS. 8 and 9. However, in this embodiment, the center portion 73' is offset from the center of the putter head 63. In this embodiment, the portion 73' separates the toe bore **71*a* from the heel bore 71*b*. The toe bore 71*a* is internally threaded to receive the weight management system 7". The system includes the weight assembly 15' as shown in FIG. 3**.

It should be understood that the heel bore **71*b* could also be threaded to receive a weight assembly for weight management. Likewise, the bores 71 shown in FIG. 9 could also be threaded to receive a weight assembly. The weight assembly 15' shown in FIG. 10** is only a preferred type with the other weight assemblies described in this application also being adaptable for this embodiment.

In this embodiment, the weight and sweet spot of the putter can be adjusted by rotating the weight assembly 15 to a desired location along the longitudinal axis of the toe bore **71*a***.

Figure 11:
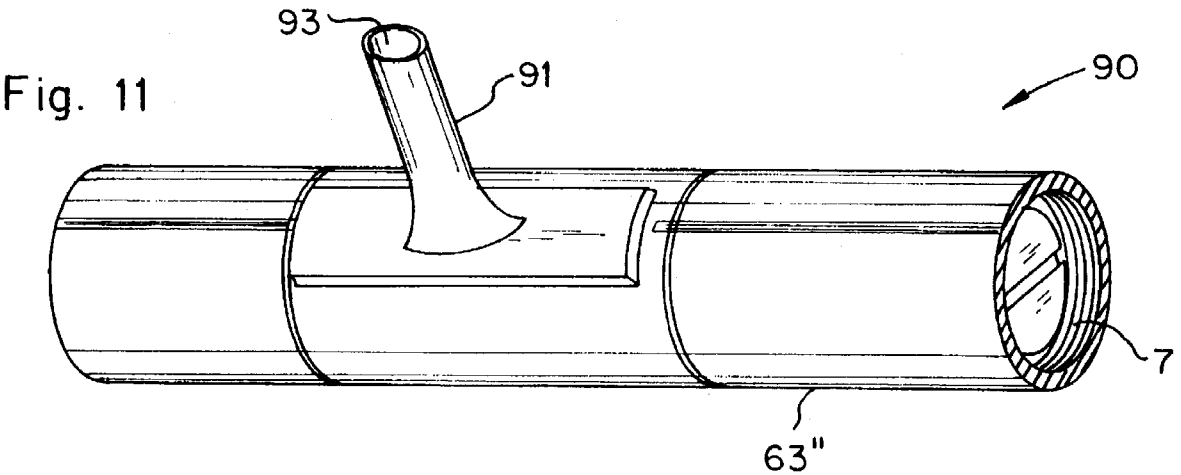
FIG. 11 is a perspective view of a fifth embodiment of the invention.

FIG. 11 shows a fifth embodiment of the invention. In this embodiment, generally designated by the reference numeral 90, a hosel 91 is attached to the cylindrical putter head 63". Preferably, the hosel 91 is forged or cast as a one piece design and is secured to the putter head 63" in any conventional fashion, adhesive bonding, brazing, soldering or mechanical fastening.

The hosel 91 includes a bore 93 which is sized to receive a shaft of the putter, shaft attachment achieved by adhesives, mechanical fastening or the like. This embodiment can also include a weight management system similar to that disclosed in the embodiment disclosed in FIGS. 1–3. In this embodiment, the putter head 63" is merely a hollow cylindrical pipe which is internally threaded to receive one of the weight assemblies described above for weight and sweet spot adjustment. This embodiment is easily manufactured since a hollow tube can be utilized as the putter head with the tube being threaded on its interior to receive one of the weight assemblies. The hosel is then easily attached to the outer surface of the tube to facilitate attachment or receipt of a putter shaft. Again, the putter head 63" also has a diameter approximating the diameter of a golf ball to achieve equator to equator contact between the putter head and golf ball during putting.

As such, an invention has been disclosed in terms of preferred embodiments thereof which fulfill each and every one of the objects of the present invention as set forth hereinabove and provides a new and improved putter.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A putter comprising a) a shaft;

b) a putter head attached to one end of the shaft, said putter head having a flat putting surface and a sweet spot adjuster integrally formed with said putter head, said sweet spot adjuster comprising a cylindrical threaded bore extending through a portion of said putter head and being aligned parallel to said flat putting surface and a unitary threaded weight assembly sized to be threaded into said cylindrical threaded bore, said cylindrical threaded bore positioned in said putter head so that an axis of said shaft where said shaft meets said putter head intersects said cylindrical threaded bore, said unitary threaded weight assembly being movable along an axis of said cylindrical threaded bore to fine tune the location of a sweet spot in said putter head and further comprising a slotted and threaded plug having a threaded leg extending from one side thereof, at least one annular weight mounted on said threaded leg and a fastener securing said annular weight to said threaded plug.

2. The putter of claim 1 wherein the outer diameter of the plug matches an inner diameter of the cylindrical threaded bore.

* * * * *